US010761488B2

(12) United States Patent
Lehmann

(10) Patent No.: US 10,761,488 B2
(45) Date of Patent: Sep. 1, 2020

(54) PACKAGING BOX FOR TIMEPIECES DEVICE FOR TESTING AND/OR TIMING A TIMEPIECE

(71) Applicant: OMEGA SA, Biel/Bienne (CH)

(72) Inventor: Jose Lehmann, Bevaix (CH)

(73) Assignee: OMEGA SA, Biel/Bienne (CH)

( * ) Notice: Subject to any disclaimer, the term of this patent is extended or adjusted under 35 U.S.C. 154(b) by 245 days.

(21) Appl. No.: 15/958,011

(22) Filed: Apr. 20, 2018

(65) Prior Publication Data

US 2018/0348707 A1 Dec. 6, 2018

(30) Foreign Application Priority Data

Jun. 2, 2017 (EP) ..... 17174165

(51) Int. Cl.
*G04D 7/12* (2006.01)
*G04D 1/06* (2006.01)

(52) U.S. Cl.
CPC ..... *G04D 7/1214* (2013.01); *G04D 1/063* (2013.01); *G04D 7/12* (2013.01); *G04D 7/1264* (2013.01)

(58) Field of Classification Search
CPC ..... G04D 7/00; G04D 7/12; G04D 7/1214; G04D 7/1264; G04D 1/06; G04D 1/063; B65D 81/05; B65D 25/24; B65D 25/04; B65D 25/02
USPC ..... 73/1.52, 1.53, 855, 12.06, 12.09, 12.13
See application file for complete search history.

(56) References Cited

U.S. PATENT DOCUMENTS

| | | | | |
|---|---|---|---|---|
| 6,557,707 | B1 * | 5/2003 | Yen | B65D 73/02 206/714 |
| 9,261,427 | B2 * | 2/2016 | Kuo | G01M 7/08 |
| 2011/0032701 | A1 * | 2/2011 | Zhang | F21V 5/007 362/244 |
| 2013/0208472 | A1 * | 8/2013 | Nishimori | G01N 21/8806 362/244 |
| 2014/0077349 | A1 * | 3/2014 | Higgins, III | H01L 21/565 257/692 |

FOREIGN PATENT DOCUMENTS

| | | |
|---|---|---|
| CH | 382651 | 9/1964 |
| FR | 1 326 527 | 5/1963 |
| GB | 712302 | 7/1954 |

OTHER PUBLICATIONS

European Search Report dated Nov. 23, 2017 in European Application 17174165.5 filed on Jun. 2, 2017 (with English Translation of Categories of cited documents).

* cited by examiner

*Primary Examiner* — Suman K Nath
(74) *Attorney, Agent, or Firm* — Oblon, McClelland, Maier & Neustadt, L.L.P.

(57) ABSTRACT

A watch packaging box including a base containing a removable tray, a lid cooperating in a complementary manner with the base to close the box, the tray including compartments for receiving a watch, each delimited by a bottom and a partition, the box including, centred inside each compartment, a resilient pad pressed onto a watch by the lid in the closed position, and the box includes, in each compartment, a main orifice for passage of a sensor or tool, included in a device performing a watch testing and/or timing method, on the watch occupying the compartment, and each resilient pad includes a secondary orifice aligned with a main orifice for access of the sensor or tool to the watch.

26 Claims, 8 Drawing Sheets

PACKAGING BOX FOR TIMEPIECES DEVICE FOR TESTING AND/OR TIMING A TIMEPIECE

This application claims priority from European Patent Application No. 14174165.5 filed on Jun. 2, 2017; the entire disclosure of which is incorporated herein by reference

FIELD OF THE INVENTION

The invention concerns a packaging box for timepieces comprising externally, on one hand, a base arranged to hold inside at least one removable tray, and on the other hand, at least one lid arranged to cooperate in a complementary manner with the base to close the box, each tray comprising at least one inner compartment for receiving a timepiece, the compartment being delimited by a bottom and a peripheral partition, and the box comprising, in each compartment, at least one resilient pad arranged to be centred in the compartment and to be pressed onto a timepiece by the lid when the box is closed.

The invention also concerns a device for testing and/or timing timepieces, comprising at least one manipulator arranged to manipulate at least one such box, comprised in such device.

The invention also concerns a method for testing and/or timing a timepiece.

The invention concerns the field of testing or timing timepieces, especially watches, or "watch heads", or mechanical timepiece movements.

BACKGROUND OF THE INVENTION

Testing and timing timepieces, especially watches, or "watch heads", or mechanical timepiece movements, requires the object to be handled multiple times, in particular for chronometric tests, where the mechanism is tested in the different positions required for chronometer certification, but also in the closest possible conditions to wear. Chronometric testing and timing are frequently supplemented with other tests: water resistance, sensitivity to magnetic fields, to shocks, to temperature or otherwise.

It is therefore a matter of ensuring that these tests and checks are run in a reliable manner, while safeguarding the mechanism subjected to testing, and while allowing, if possible, for automated observations, possibly supplemented by adjustments or markings, while ensuring product traceability and the link between the object and any tests and adjustments carried out.

The quest for reliability is compatible with a quest for productivity, and therefore horological production must be adapted to manipulations with the most modern tools, with the highest possible degree of automation.

SUMMARY OF THE INVENTION

The invention proposes to provide the means allowing for perfect intermediate packaging of such timepieces, especially during the final testing and/or timing operations, and arranged to allow interventions in contact with or in close proximity to the mechanisms.

To this end, the invention concerns a timepiece packaging box.

The invention also concerns a device for testing and/or timing timepieces, comprising at least one manipulator arranged to manipulate at least one such box.

The invention also concerns a method for testing and/or timing a timepiece.

BRIEF DESCRIPTION OF THE DRAWINGS

Other features and advantages of the invention will appear from reading the following detailed description, with reference to the annexed drawings, in which.

DETAILED DESCRIPTION OF PREFERRED EMBODIMENTS

Figure 1:
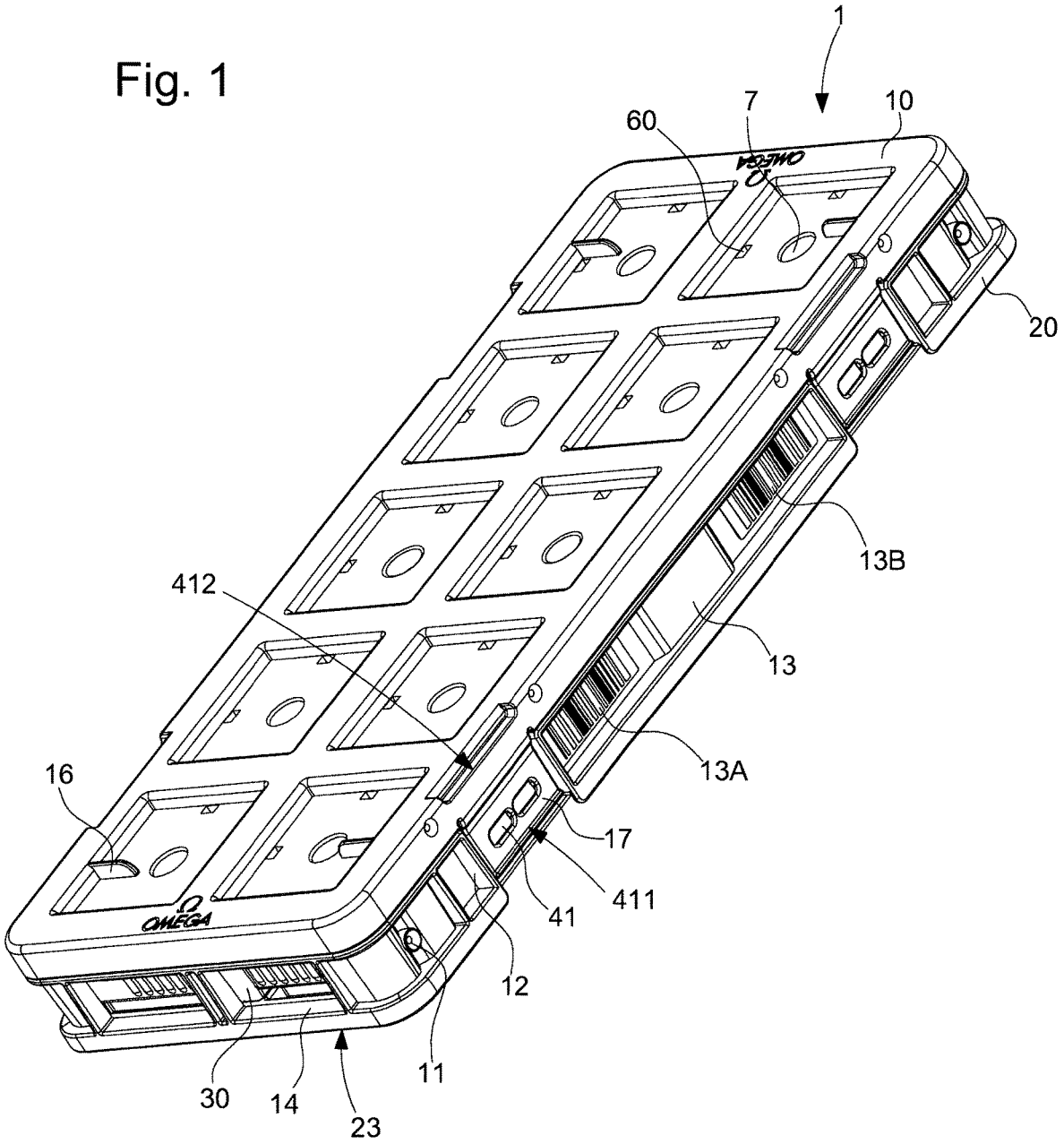
FIG. 1 represents a schematic, perspective view of a timepiece packaging box which comprises, in its lower portion, a base that contains a tray visible through end orifices in the base, this tray being immobilised, in a closed position of the box, by a lid in the upper portion, and snap fitted onto the base. The lid comprises a plurality of main orifices intended to allow access to timepieces disposed in compartments in the tray. The outer sides of the base and of the lid comprise indexing elements such as ribs or centering elements, and different identification elements, comprising bar codes here.
Figure 2:
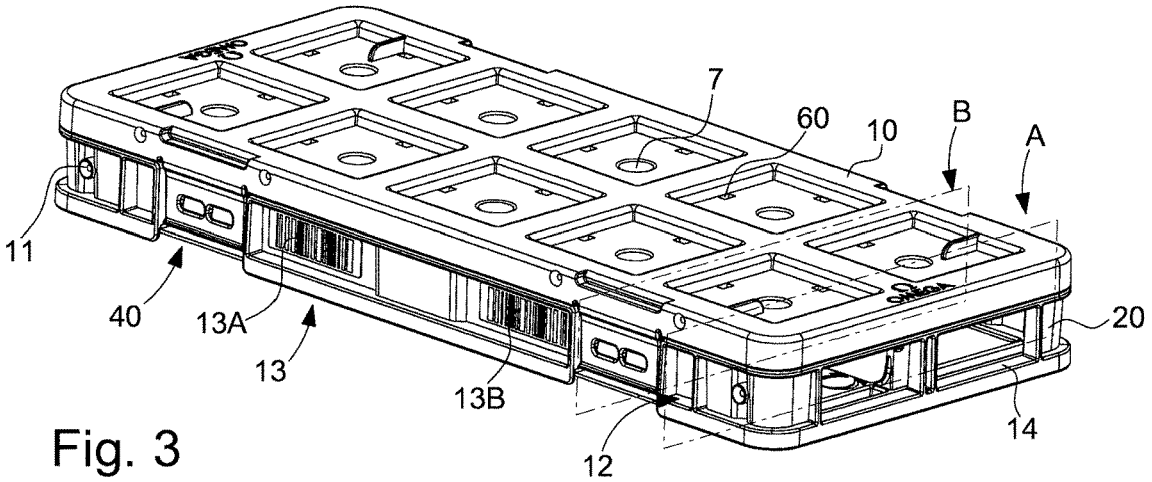
FIG. 2 represents a schematic, perspective, top view of an assembly created only with the base and lid.
Figure 3:
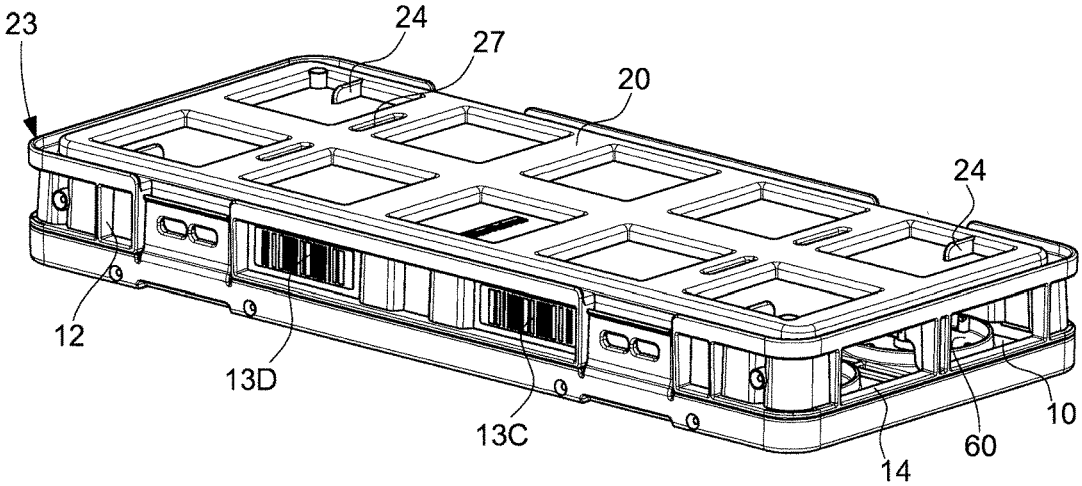
FIG. 3 represents, in a similar manner to FIG. 2, the same assembly in perspective from below.
Figure 4:
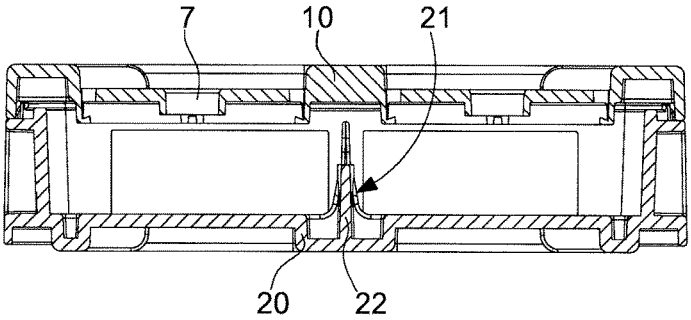
FIG. 4 represents a schematic view of the same assembly in cross-section along section A-A of FIG. 2, passing through two main orifices in the lid.
Figure 5:
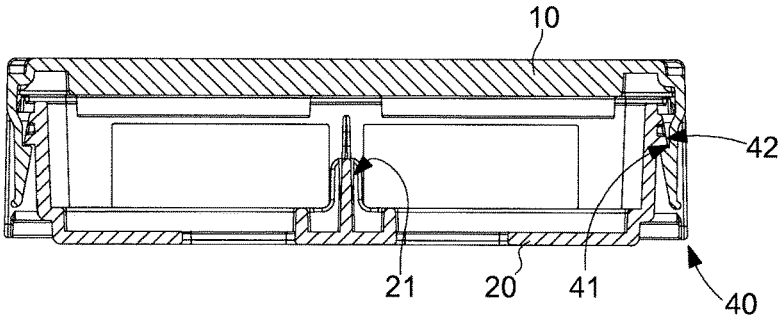
FIG. 5 represents a schematic view of the same assembly in cross-section along section BB of FIG. 2, passing through the box closing means.
Figure 6:
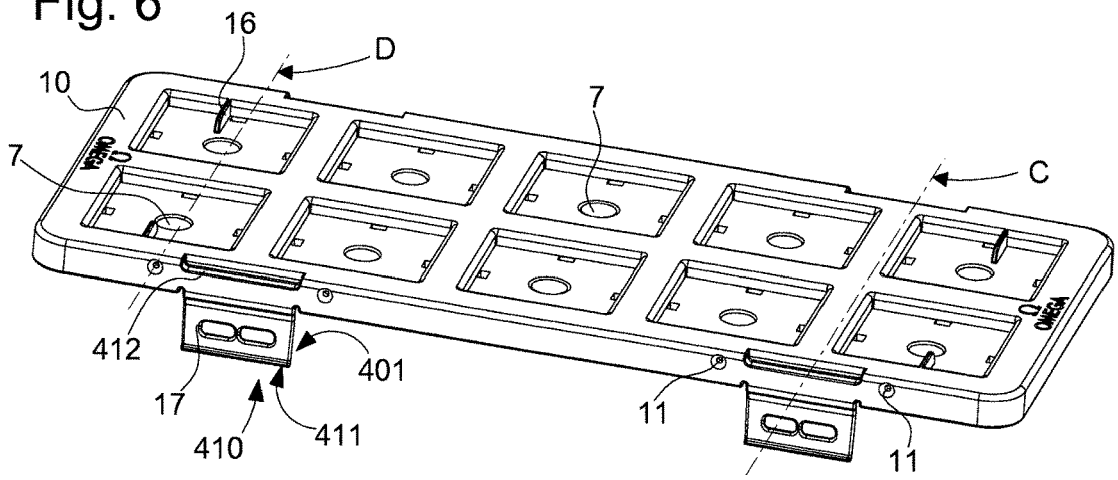
FIG. 6 represents a schematic, top, perspective view of the lid.
Figure 7:
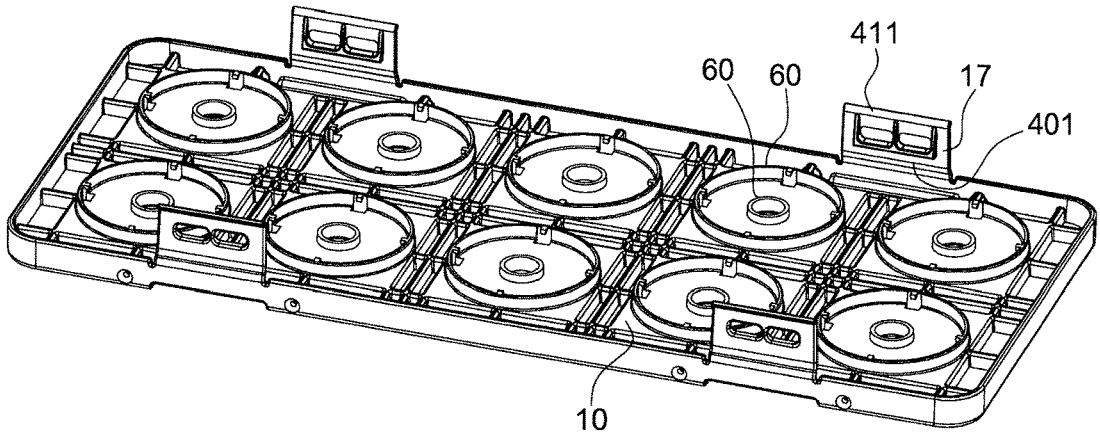
FIG. 7 shows a schematic view of the lid in perspective from below.
Figure 8:
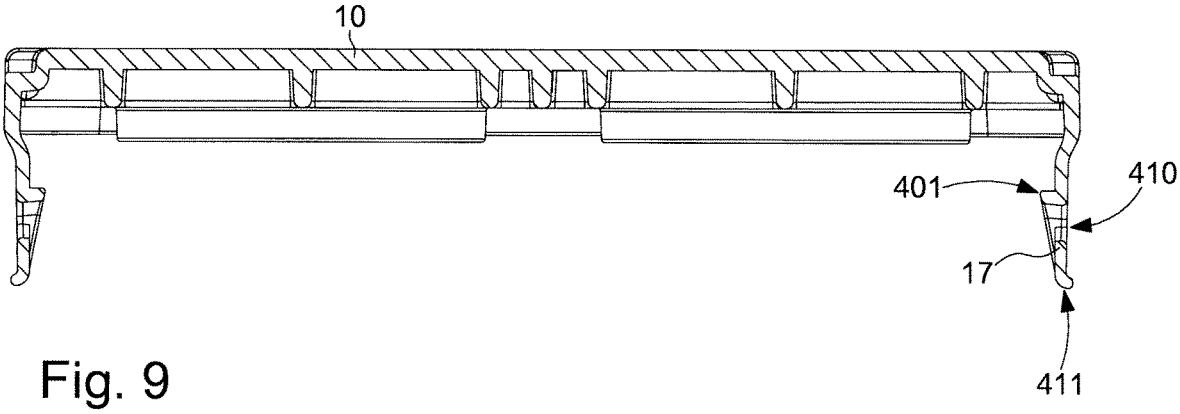
FIG. 8 represents a schematic view of the same lid in cross-section along section CC of FIG. 6, passing through means for closing the box.
Figure 9:
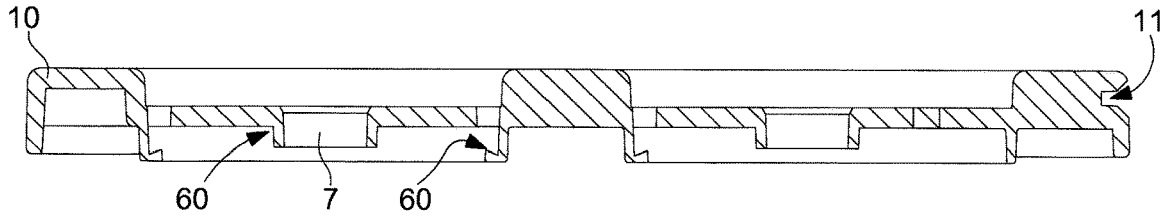
FIG. 9 represents a schematic view of the same assembly in cross-section along section DD of FIG. 6, passing through two main orifices in the lid.
Figure 10:
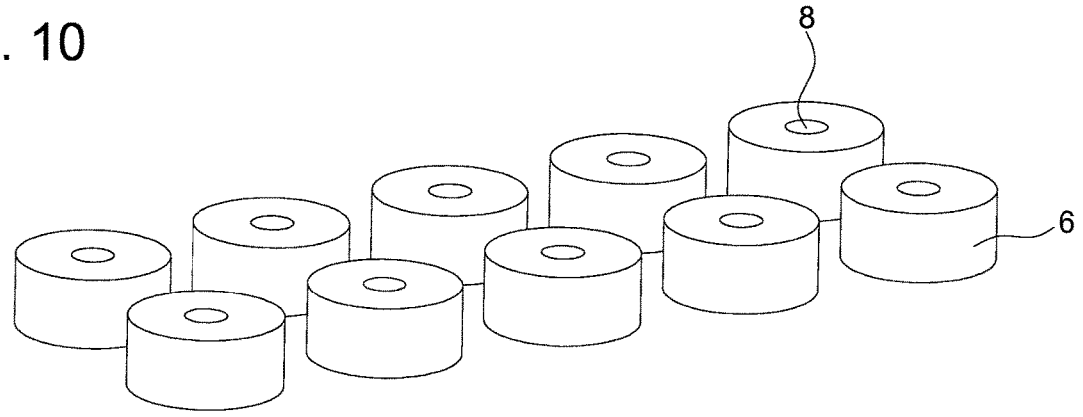
FIG. 10 represents a schematic, perspective, top view of a set of resilient pads comprised in the box of FIG. 1, arranged to be pressed by the lid onto the timepieces disposed in the tray compartments, and which each comprise a secondary orifice intended to be aligned with a main orifice of the lid.
Figure 11:
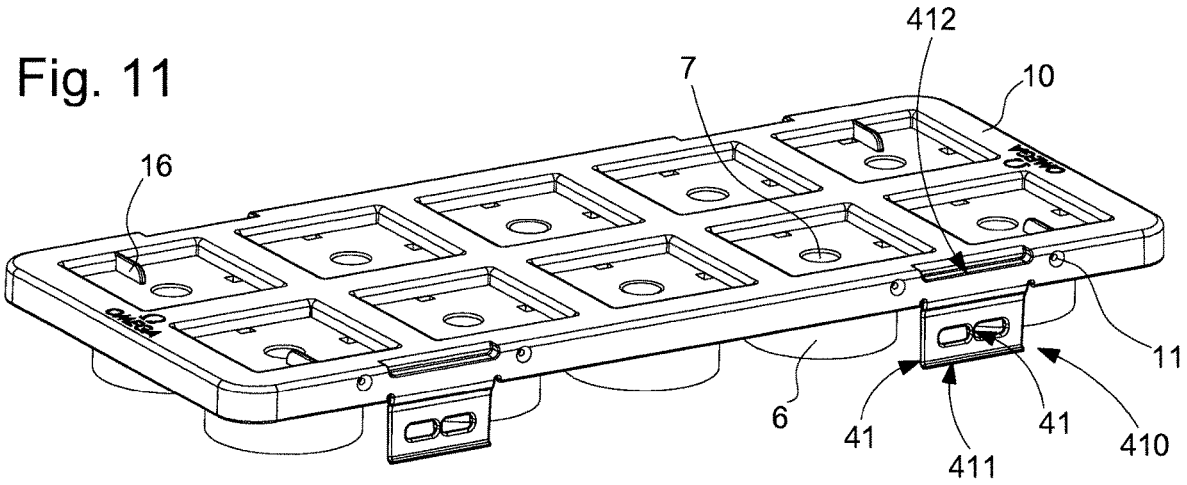
FIG. 11 represents a schematic, perspective, top view of the lid equipped with this set of resilient pads, attached to holding means comprised in the lid, such that, when the lid is placed on a plane resting on feet, which also form upper closing means, the resilient pads remain at a distance from this plane.
Figure 12:
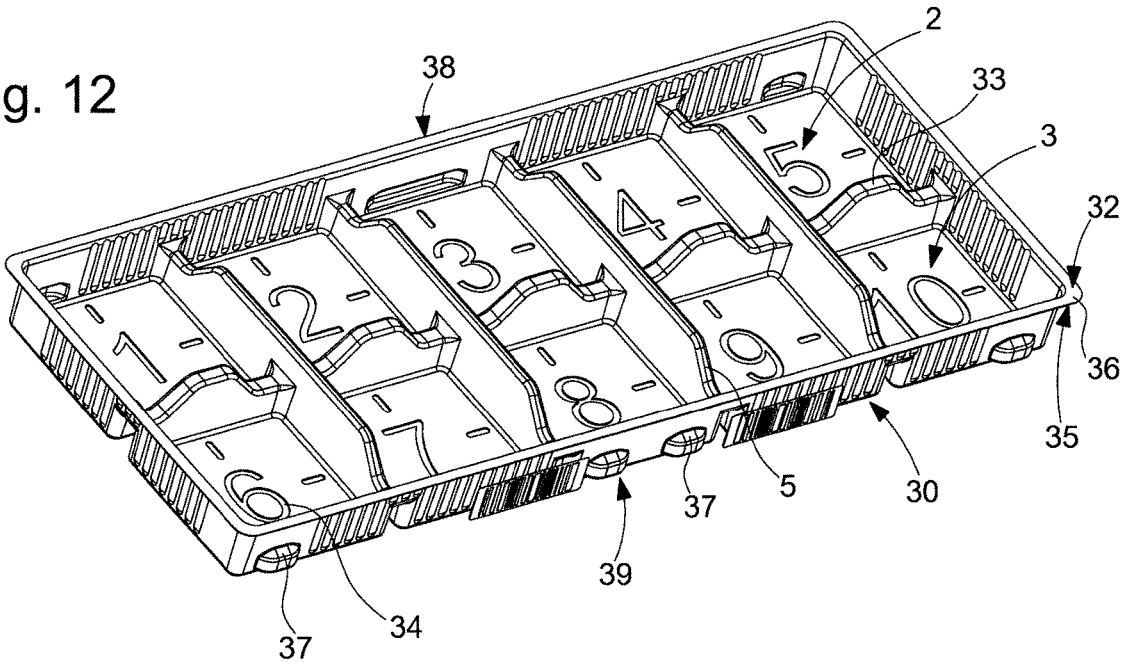
FIG. 12 represents a schematic, perspective, top view of the tray comprised in the box of FIG. 1, with isolated compartments each bearing a different marking, this tray comprising a peripheral tongue for support on the base, and further comprising, laterally, foolproof positioning elements, and side support blocks.
Figure 13:
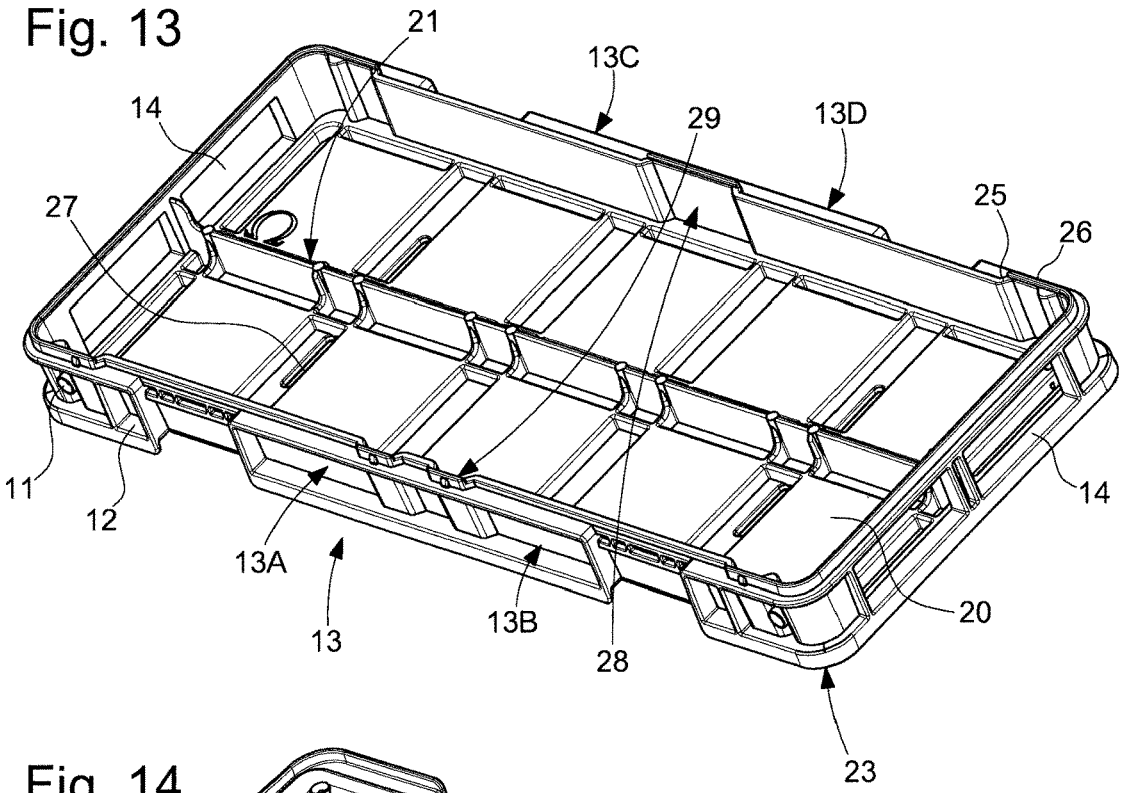
FIG. 13 represents a schematic, perspective, top view of the base of the box, also provided with foolproof positioning elements, and bordered by two ribs of different height; the bottom of this base comprises oblong slots that form passages for a tool for separating, if necessary, the base and a tray.
Figure 14:
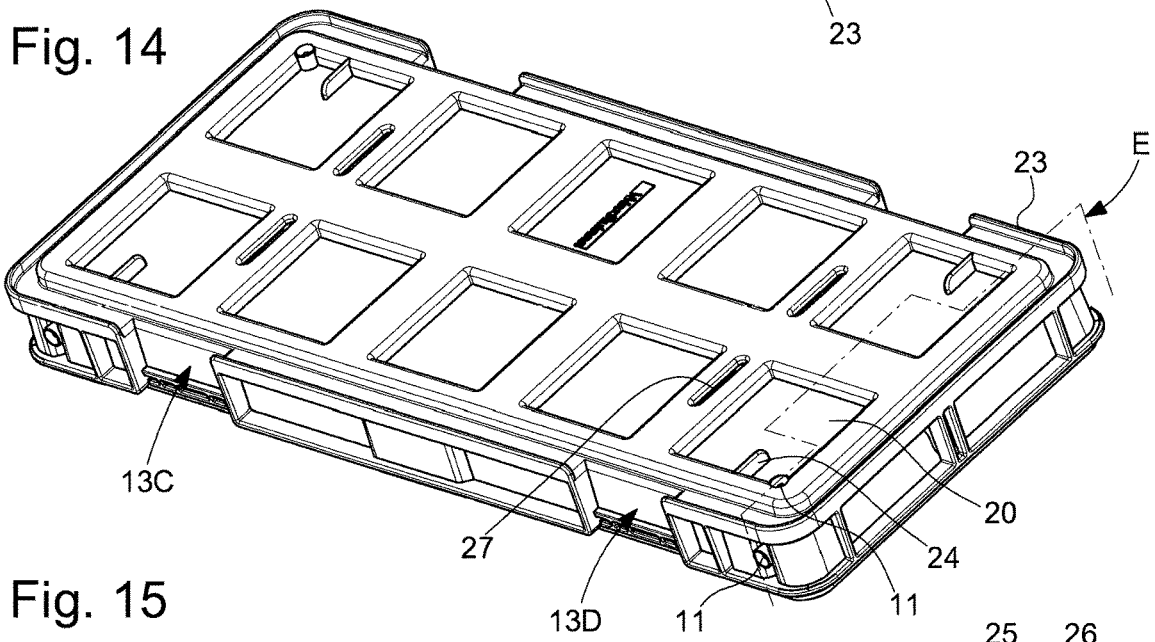
FIG. 14 shows the same base, in a schematic, partial, perspective view from below.
Figure 15:
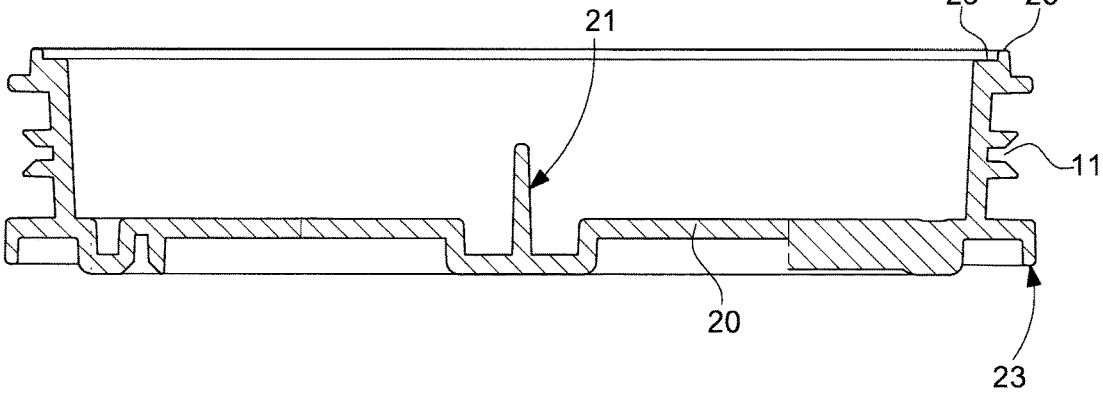
FIG. 15 represents a schematic view of the same base in cross-section along section EE of FIG. 14, passing through two indexing elements.
Figure 16:
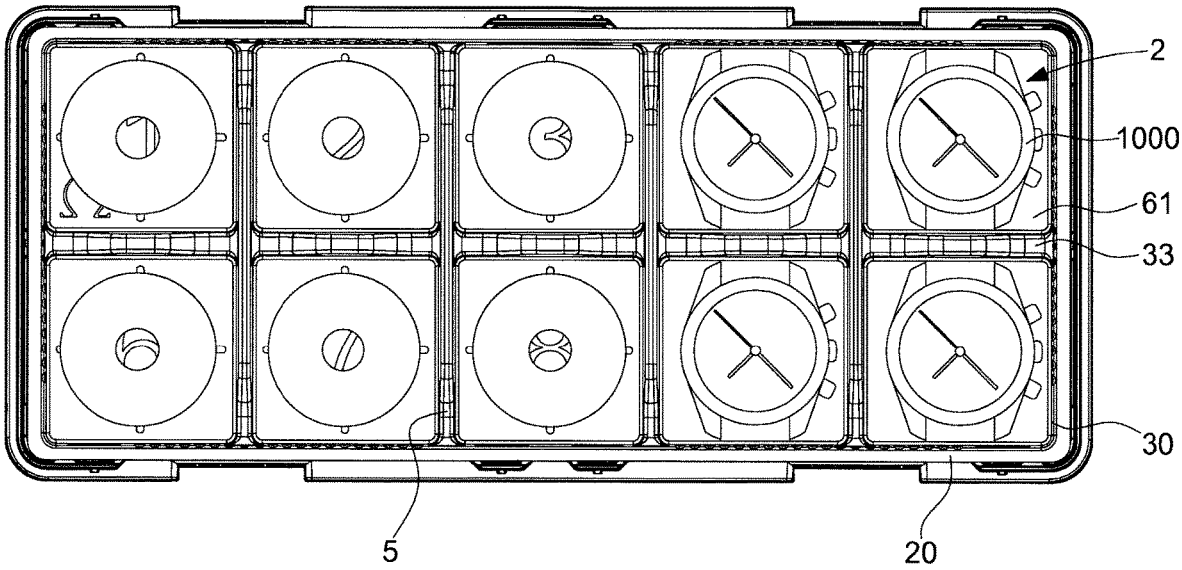
FIG. 16 represents a schematic, top view of the tray of FIG. 12 inserted into the base, and comprising, in each of its compartments, a timepiece, which is a watch head here, locked in position by complementary holding means.
Figure 17:
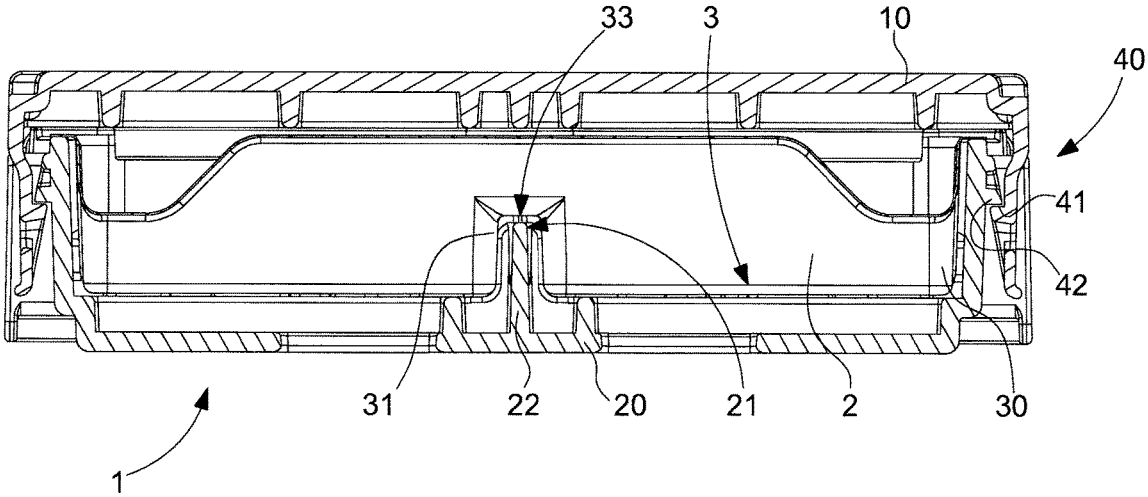
FIG. 17 shows a schematic view of the box of FIG. 1, in cross-section through means for closing the box.
Figure 18:
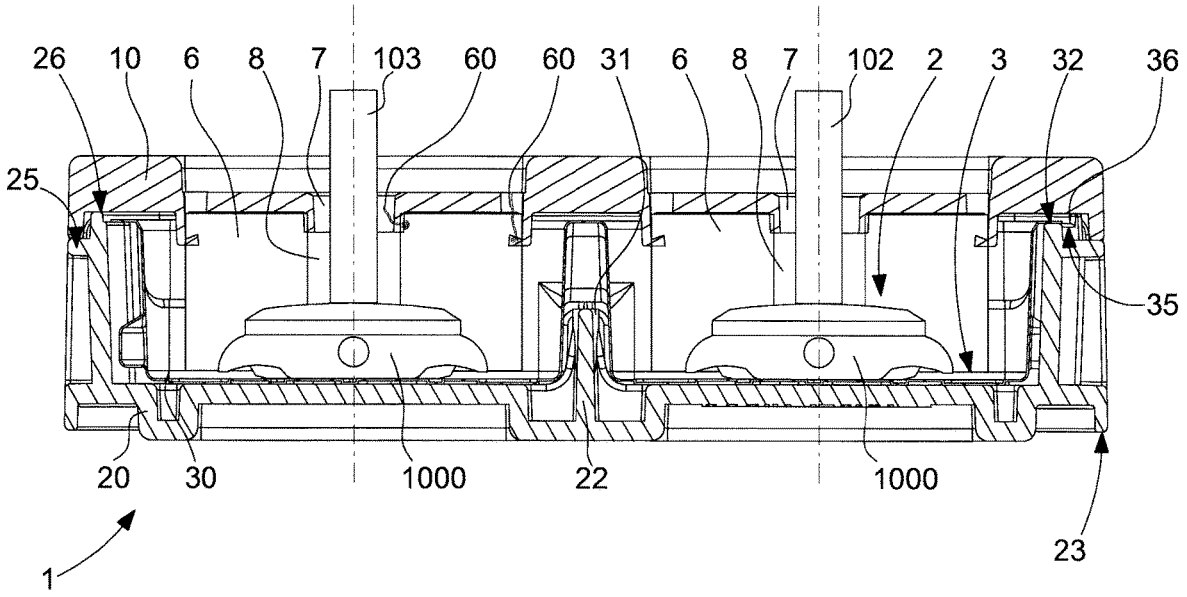
FIG. 18 represents, in a similar manner to FIG. 17, the same box, filled with watch heads, and the direct access of a sensor or a tool to the watch head, through the main orifice in the lid, and the secondary orifice in the resilient pad, which are aligned above the watch head.
Figure 19:
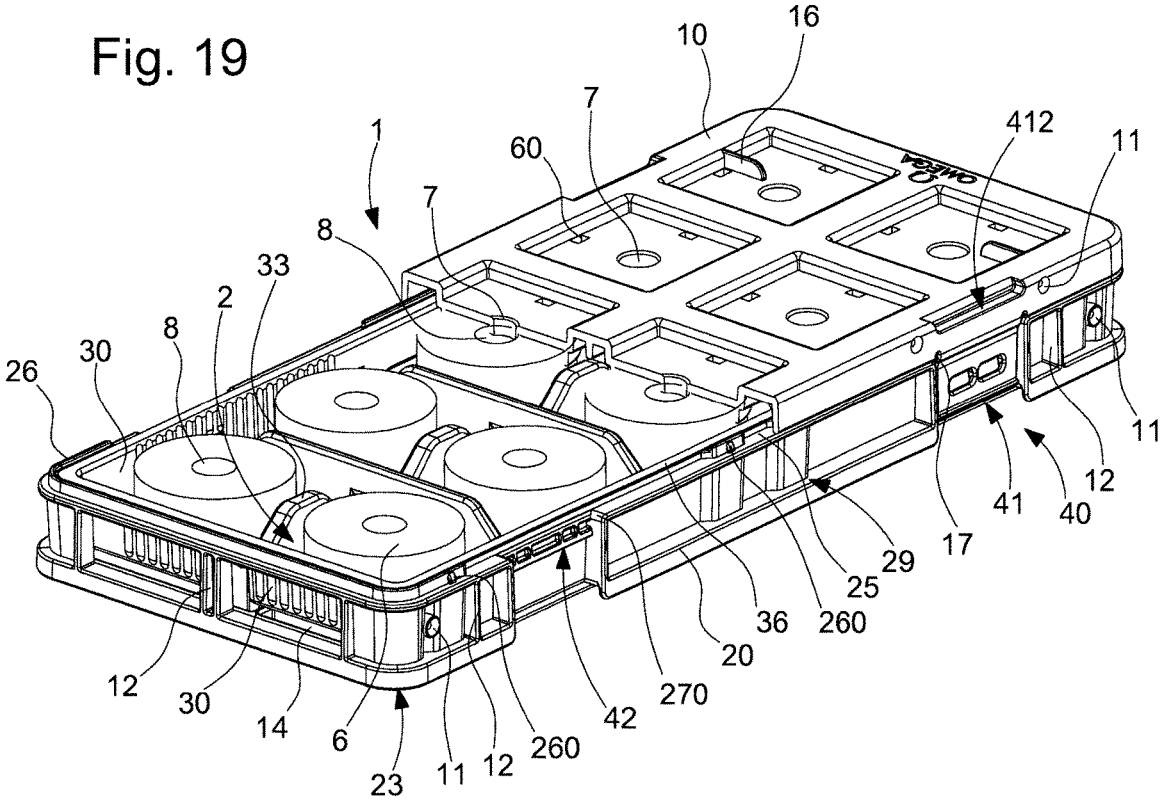
FIG. 19 represents, in truncated perspective, the box of FIG. 18, in the same configuration, with the watch heads not visible as they are each covered by a resilient pad, this box being ready for the insertion of a sensor or tool.
Figure 20:
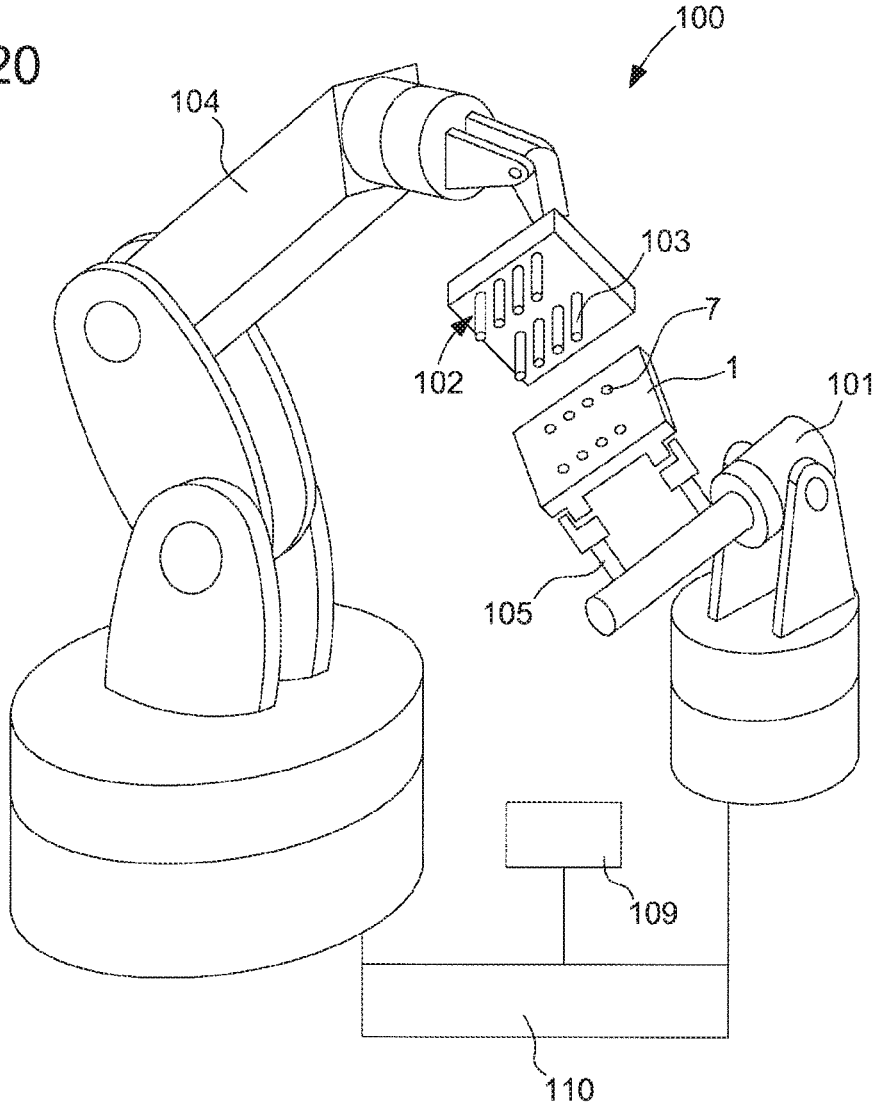
FIG. 20 represents a schematic, perspective view of a device for manipulating such boxes and heads comprising sensors or adjustment tools.
Figure 21:
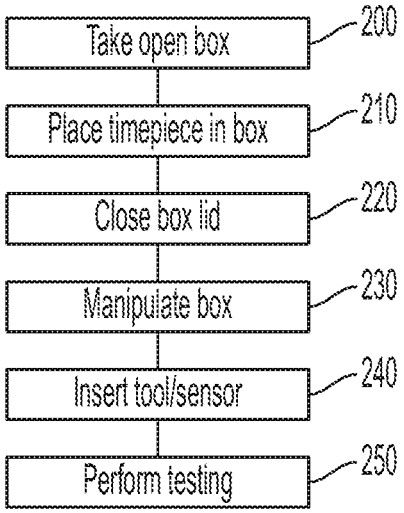
FIG. 21 is a block diagram of the main steps of a timepiece checking and/or adjustment method implemented with such boxes and with this device.

The invention concerns a packaging box 1 for timepieces 1000. "Timepieces" means here watches or watch heads, or timepiece movements, particularly mechanical movements, or timepiece components, or any similar assembly.

This box 1 includes externally, on the one hand, a base 20 arranged to hold inside at least one removable tray 30, and on the other hand, at least one lid 10, which is arranged to cooperate in a complementary manner with base 20 to close box 1.

Each tray 30 comprises at least one inner compartment 2 for receiving a timepiece 1000. This compartment 2 is delimited by a bottom 3, which forms part of tray 30, and a peripheral partition 5, which forms part of tray 30, and which may be removable in a particular, non-illustrated variant.

Box 1 comprises, in each compartment 2, at least one resilient pad 6 arranged to be centred inside compartment 2, and to be pressed onto a timepiece 1000 placed in compartment 2, by lid 10 when box 1 is closed.

This resilient pad 6 is chosen to rest directly on the timepiece 1000 concerned and is arranged to deform to perfectly match its shape and lock it in position. In a variant, this resilient pad is provided, on a contact surface, with a surface film.

Advantageously, this resilient pad 6 is made of a material selected to provide good phonic isolation, so as to allow the rate of a particular timepiece 1000 to be tested by microphone, without disturbing the nearby timepieces 1000. In particular, resilient pad 6 has the texture of a flexible foam.

The same resilient pad 6 can lock in place various timepieces 1000, of any size, and of any width.

This resilient pad 6 is essential to the invention and must therefore be replaced as soon as it shows signs of deterioration, such as not returning to its initial thickness when empty, insufficient thickness dimension, tears, or otherwise. To this end, the implementation of box 1 according to the invention is accompanied by frequent checks, throughout the cycle, of the resilient pads 6 comprised therein.

Advantageously, lid 10 comprises holding means 60, which are arranged to hold each resilient pad 6 on the lid, in an upper housing 15, comprised in lid 10, these holding means 60 may be manufactured with lid 10, made, for example, by plastic injection moulding, and have a hook or similar shape ensuring that resilient pad 6 is retained in all positions. Thus, checking resilient pads 6 during the cycle is facilitated, since this check can be effected simply by a height check, particularly but not limited to an optical check, on lid 10 provided with all its resilient pads 6.

More particularly, lid 10 comprises, directly above each compartment 2, an upper housing 15, which is arranged to clamp and hold a resilient pad 6, and which can form holding means 60, or be supplemented by holding means 60.

According to the invention, box 1 comprises, in each compartment 2, at least one main through orifice 7, which is arranged to allow a sensor or tool access to a timepiece 1000 occupying compartment 2.

This main through orifice 7 may be arranged in lid 10, as seen in the preferred embodiment illustrated by the Figures, but also in base 20.

And each resilient pad 6 comprises at least one secondary orifice 8, which is arranged to cooperate in alignment with a main orifice 7, and to allow such a sensor or tool access to the timepiece 1000 occupying compartment 2.

The invention is illustrated in the Figures with upper resilient pads 6 on the lid 10 side, and it is understood that a variant of the invention may function with lower resilient pads, on the bottom 3 side of tray 30, or even both with upper resilient pads 6 and lower resilient pads, on both sides of each timepiece 1000. In such case, in particular, tray 30 may comprise, directly beneath each compartment 2, a lower housing arranged to clamp and hold a resilient pad 6.

In particular, base 20 comprises a bearing surface 21 which is arranged to engage, by pressing and/or clamping, with a complementary surface 31 comprised in each removable tray 30. In the particular embodiment illustrated by the Figures, bearing surface 21 is formed of all the lateral surfaces of a median rib 22 comprised in base 20, while complementary surface 31 is formed of the lateral inner surfaces of a hollow rib 33 comprised in tray 30. More particularly, the geometry of bearing surface 21 and that of complementary surface 31, and the materials of base 20 and of tray 30 are selected so that the cooperation between bearing surface 21 and complementary surface 31 occurs with slight pinching. In a particular illustrated variant, base 20 comprises at least one passage 27, which is arranged to allow the passage of at least one tool for removing a tray 30 from box 20, in the event of sticking therebetween.

More particularly, in order to close and clamp resilient pads 6, box 1 comprises closing means 40, which are arranged in base 20 and lid 10, for pressing lid 10 onto bottom 3 in a compressed state of each resilient pad 6. In the particular embodiment illustrated by the Figures, closing means 40 comprise at least one lower closing element 42 integral with base 20, arranged to cooperate in a complementary manner with at least one upper closing element 41, particularly a clip 401, integral with lid 10. In this particular example, a lower closing element 42 engages in a clip fit with an upper closing element 41, which is advantageous in allowing easy opening/closing by an automated manipulator.

To allow for automated manipulation, box 1 comprises, externally, a plurality of indexing elements 11 to define its position and orientation in space. These indexing elements 11 may, as seen in the Figures, be arranged both in base 20 and in lid 10, to allow for automated manipulation of base 20 alone, lid 10 alone, or of the entire assembled box 1.

Advantageously, in a plastic injection moulded embodiment of base 20 and/or of lid 10, these indexing elements 11 correspond to the injection orifices for the material. These indexing elements 11 may also be elements that are machined, or added, such as labels, targets, pins, by bonding, press fit, screws, welding or otherwise.

More particularly, box 1 comprises, externally, a plurality of gripping means 12, for holding and moving the box by automated production means. These gripping means 12 may be formed by ribs, calibrated cavities, or suchlike.

Box 1 advantageously comprises, externally, at least one identification element 13 for the identification thereof, and/or positioning thereof in space, and/or for the identification of products contained therein. More particularly, each identification element 13 comprises a marking such as a bar code or similar. The encoding of an identification element 13 is not necessarily optical, identification element 13 may, for example, be formed of an RFID chip or similar. More particularly, box 1 comprises several identification elements 13, 13A, 13B, 13C, 13D, . . . , which differ, at least partially, in a different coding area, to identify the different sides of box 1. In a complementary manner, more particularly, base 20 comprises at least one foolproof positioning element 28 and a second foolproof positioning element 29, each arranged to cooperate in a complementary manner with a first complementary foolproof positioning element 38, respectively a second complementary foolproof positioning element 39, comprised in each tray 30, to ensure a unique relative orientation of a tray 30 with respect to base 20. The coding outside box 1 thus perfectly identifies the position of the tray 30 contained therein. In this regard, the invention is illustrated with a single tray 30, but it is understood that it can be made in different variants, particularly trays 30 of smaller length or width to that of base 20, juxtaposed with one another.

To facilitate the assembly of the components of box 1, base 20 advantageously comprises small, slightly sloped, protruding, raised portions 260, arranged to push back the material of lid 10 slightly, and move it away, thereby facilitating its insertion. These raised portions have very small dimensions, for example a width on the order of a millimetre, a slope on the order of a millimetre, a slope length on the order of a few millimetres, for a box 1 capable of containing 10 timepiece components or watches. These small raised portions are distributed at the periphery, for example on the foolproof positioning elements and at the ends of the box. Some of these raised portions are advantageously formed by indexing cones.

Naturally, identification elements 13 may also comprise purely geometrical alignment and/or position marks. Indexing elements 11 may also be arranged in a different manner on the different sides of box 1. Some of these machined portions 11 may also be closed to ensure this differentiation.

Preferably, at least one identification element 13, and/or a group of indexing elements 11, defines at least one reference orientation with respect to gripping means 12.

More particularly, box 1 comprises at least one through orifice 14, especially a fluid port, to allow the passage, between the outside and inside of box 1, of a gaseous fluid and/or liquid flow, for a cleaning, temperature setting, water resistance test or other function. This through orifice 14 may be arranged in base 20 and/or in lid 10. Such a through orifice 14 may also be used for reading an identifier borne by a tray 30 contained inside box 1, or for the passage of a mechanical gripper, tool, sensor or suchlike. The Figures show such through orifices 14 on the smallest sides of base 20.

Box 1 is advantageously designed to be stacked; both the entire box 1, and its various components with other components of the same type, which saves a significant amount of space.

In a particular embodiment, as illustrated by the Figures, base 20 comprises a low peripheral rib 25, which is arranged to form a low support surface for a lower rim 35 of a peripheral tongue 36 of each tray 30. An upper rim 32 of the same tray 30 is arranged to remain set back, or just flush with, a high peripheral rib 26 comprised in base 20.

More particularly, at least high peripheral rib 26, or low peripheral rib 25 is arranged to cooperate with a peripheral surface 23 comprised, opposite to high peripheral rib 26 or low peripheral rib 25, in another identical base 20 for the stacking thereof one atop the other.

Likewise, more particularly, each tray 30 can be stacked on another identical tray 30, resting on side support blocks 37, and box 1 comprises at least one cover arranged to cover and close the uppermost tray 30 of the stack. In a variant, these side support blocks 37 can also be used for a stop support on a boss of base 20.

Advantageously, trays 30 have a marking 34 for each compartment 2, for example a numeral as seen in the Figures. Advantageously, the different compartments 2 of a given tray 30 are thus individually identified, for example by a number injected integrally with tray 30. This allows for easy identification by a manipulator or an operator, if one of the timepieces has to be removed, for example to be fed into a timing adjustment loop, or otherwise.

In a variant, at least one additional support 61, such as foam or suchlike, can occupy a housing 2 to hold up a timepiece 1000 and define its position.

Similarly, more particularly, each lid 10 comprises feet 17, which are arranged to stack said lid on a lid 10 of the same type with no contact with the resilient pads 6 of the other lid 10. Indeed, it is important for the surfaces of resilient pads 6, which are intended to come into direct contact with timepieces 1000, are protected from any pollution such as dust, fluid or other. Each foot 17 then has a lower surface 411, which is arranged to come to bear on an opposite, complementary upper surface 412, during such stacking; advantageously, the joining surfaces between these complementary upper surfaces 412 and the large upper face of lid 10 have a radius arranged to slide the feet 17 of the uppermost lid of the stack and move them apart slightly for precise positioning in a stop position. In the particular embodiment illustrated, these feet also form upper closing elements 41.

Similarly, base 20 may comprise radii 270 arranged to facilitate the insertion of lid feet 17 before they are clipped in.

Advantageously, each foot 17, on its largest surface, has the shape of an isosceles trapezium, narrower at its distal end than at its attachment to lid 10, so as to fulfil a longitudinal centering function with respect to a wide notch with parallel or oblique faces, comprised in base 20, when lid 10 is clipped onto base 20, in the position of FIG. 1. Thus, indexing elements 11, and/or gripping means 12, which are on either side of the assembled lid 10 and base 20, are perfectly aligned, and a handling manipulator can operate with minimum clearance.

In a particular embodiment, the components of box 1 are all made of plastic material, in particular by injection moulding to ensure reproducible geometric quality, especially polypropylene or suchlike. At least bases 20 and lids 10 are designed to be periodically washed, for example by an automatic ultrasonic washing system; trays 30 can also benefit from this type of washing. Resilient components 6 are neither washed nor recycled, these are wear parts that are periodically measured and rejected once their thickness can no longer guarantee that a timepiece 1000 will be properly held inside a compartment 2, or once signs of wear, tear or contamination are observed.

The invention also concerns a device 100 for testing and/or timing timepieces. This device 100 comprises at least one manipulator 101, which is arranged to manipulate, particularly by means of at least one gripper 105, at least one such box 1, comprised in device 100. Such a manipulator 101 or gripper 105 is arranged to cooperate with the gripping means 12 of each box 1, and/or with all or part of indexing elements 11.

Device 100 advantageously includes detection means 109, arranged to collect information from identification elements 13, and to move each manipulator 101 accordingly.

More particularly, manipulator 101 comprises at least one sensor 102 and/or a tool 103, which is arranged to be inserted through at least one main orifice 7 and a second orifice 8 aligned with said main orifice 7 in the same compartment 2, and which is arranged to make a measurement and/or an adjustment to a timepiece 1000 housed inside compartment 2.

More particularly, a sensor 102 is a microphone, or a camera, or a contact vibration sensor.

More particularly, a tool 103 is a mechanical, or magnetic or another tool.

More particularly, manipulator 101 includes as many sensors 102 and/or tools 103 as box 1 has compartments 2. In particular, manipulator 101 is a multi-axis robot, able to simulate every wear position in space, and not only the usual positions for chronometric testing, but also in any other realistic position in space. Depending on the arrangement, the same manipulator 101, or advantageously another adjacent manipulator 104, comprises an end arm which has a head provided with these various sensors 102 or tools 103, to allow simultaneous action on all the timepieces 1000 comprised in a particular box 1. Such a manipulator 101 or 104 may thus, depending on the test to be performed, implement a head equipped with sensors 102, or a head equipped with tools 103, or a mixed head equipped with both sensors 102 and tools 103, or otherwise.

More particularly, manipulator 101 is arranged to manipulate each box 1 at least in the different testing and/or chronometric timing positions, under different physical conditions: at different temperatures, at different humidity levels, under different pressures or depressions, or subjected to vibrations, or to gaseous or liquid flows, or otherwise. Of course, these operations can be performed not simply in particular positions, but also during programmed movements between different positions in space.

Manipulator 101 includes control means 110 which are arranged to control its movements in space, in addition to the duration of testing and/or timing operations in the different positions occupied by each box 1, and/or when different movements are imparted to box 1. Or course, manipulator 101 may also be arranged to manipulate several boxes 1 at once.

More particularly, device 100 comprises maneuvering means, which are arranged to open and close lids 10 with respect to bases 20, to perform magnetic field tests, and/or pressure/depression test operations, and/or water resistance test operations, and/or etching operations, and/or washing or other operations. These maneuvering means may be manipulators 101 or 104, or other automated manipulation means.

Device 100 advantageously comprises means for reading identification elements 13 of boxes 1, and means for detection of the position in space of indexing elements 11. Thus, manipulator 101 has all information relating to boxes 1, to their position, their contents, and control means 110 are preferably arranged to be interfaced with production management means to ensure the traceability of boxes 1 and their contents.

The invention also concerns a method for testing and/or timing a timepiece 1000, wherein:

(200) a box 1 is taken, in an open position;

(210) timepiece 1000 is placed inside a compartment 2 of a tray 30 of box 1, on and/or under a resilient pad 6 centred inside compartment 2 with its secondary orifice 8 in alignment with a main orifice 7;

(220) lid 10 of box 1 is closed thereby compressing each resilient pad 6, and timepiece 1000 is pressed directly or indirectly onto bottom 3;

(230) box 1 is manipulated in various positions in space;

(240) in each of these positions, a sensor 102 and/or a tool 103 is inserted through main orifice 7;

(250) at least one testing and/or timing operation of timepiece 1000 is performed by means of this sensor 102 and/or tool 103.

More particularly, this device 100 is implemented for manipulating box 1.

More particularly, this device 100 is implemented for manipulating box 1 in different testing and/or chronometric timing positions, and, in each position, timepiece 1000 is tested and/or timed.

More particularly still, the testing and/or timing of a plurality of timepieces 1000 is performed simultaneously, with each timepiece enclosed in a compartment 2 of the same box 1.

What is claimed is:

1. A packaging box for timepieces comprising:

a base arranged to hold inside at least one removable tray, and at least one lid arranged to cooperate in a complementary manner with said base to close said packaging box, each tray of said at least one removable tray comprising at least one compartment for receiving a timepiece, each compartment of said at least one compartment being delimited by a bottom and a peripheral partition, wherein said packaging box comprises, in each compartment of said at least one compartment, at least one resilient pad arranged to be centered inside said compartment, and to be pressed onto said timepiece by said packaging lid when said packaging box is closed, wherein said packaging box comprises, in each compartment of said at least one compartment, at least one main through orifice arranged to allow a sensor or tool access to said timepiece occupying said compartment, and wherein each of said at least one resilient pad comprises at least one secondary orifice arranged to cooperate in alignment with said main orifice, and to allow said sensor or tool access to said timepiece occupying said at least one compartment.

2. The packaging box according to claim 1, wherein said base comprises a bearing surface arranged to engage, by pressing and/or clamping, with a complementary surface comprised in each of said at least one removable tray.

3. The packaging box according to claim 1, wherein said packaging box comprises a closing means arranged in said base and in said lid, to press said lid onto said bottom in a compressed state of each said resilient pad.

4. The packaging box according to claim 1, wherein said packaging box comprises a plurality of indexing elements located on an exterior of the box to define a position and orientation of said packaging box in space.

5. The packaging box according to claim 1, wherein said packaging box comprises a plurality of gripping means located on an exterior of the box for holding and moving said packaging box.

6. The packaging box according to claim 1, wherein said packaging box comprises at least one identification element located on an exterior of the box for at least one of identification of said packaging box, positioning of said packaging box in space, and identification of products contained in said packaging box.

7. The packaging box according to claim 5, wherein said packaging box comprises at least one identification element located on an exterior of the box for at least one of identification of said packaging box, positioning of said packaging box in space, and identification of products contained in said packaging box, and wherein at least one said identification element defines at least one reference orientation with respect to the gripping means.

8. The packaging box according to claim 1, wherein said packaging box comprises at least one through orifice to allow the passage, between the outside and inside of said packaging box, of a gaseous fluid and/or liquid flow.

9. The packaging box according to claim 1, wherein said lid comprises, directly above each compartment of said at least one compartment, an upper housing arranged to clamp and hold said resilient pad.

10. The packaging box according to claim 1, wherein said lid comprises, directly below each compartment of said at least one compartment, a lower housing arranged to clamp and hold said resilient pad.

11. The packaging box according to claim 3, wherein the closing means comprise at least one lower closing element integral with said base, arranged to cooperate in a complementary manner with at least one upper closing element integral with said lid.

12. The packaging box according to claim 11, wherein each said lower closing element is arranged to engage in a clip fit, in said closing position, with said upper closing element.

13. The packaging box according to claim 1, wherein said base comprises at least one foolproof positioning element arranged to cooperate in a complementary manner with a complementary foolproof positioning element comprised in each of said at least one removable tray, to ensure a unique relative orientation of each of said at least one removable tray with respect to said base.

14. The packaging box according to claim 1, wherein said base comprises at least one passage arranged to allow the passage of the at least one tool for removal of said at least one removable tray from said packaging box.

15. The packaging box according to claim 1, wherein said base comprises a low peripheral rib arranged to form a low support surface for a lower rim comprised in a peripheral tongue of each of said at least one removable tray, whose upper rim is arranged to remain set back from a high peripheral rib comprised in said base.

16. The packaging box according to claim 15, wherein at least said high peripheral rib or said low peripheral rib is arranged to cooperate with a peripheral surface comprised, opposite to said high peripheral rib or said low peripheral rib, in another identical base for the stacking thereof one atop the other.

17. The packaging box according to claim 1, wherein each of said at least one removable tray can be stacked on another identical tray, supported on side support blocks.

18. The packaging box according to claim 1, wherein each lid includes feet arranged for stacking said lid onto another lid of the same type with no contact with the resilient pads of the other lid, each said foot comprising a lower surface arranged to come to bear on an opposite, complementary upper surface, during such stacking.

19. A device for testing a timepiece, comprising:

at least one manipulator arranged to manipulate at least one of the packaging box according to claim 1, comprised in said device, wherein said manipulator comprises at least one sensor and/or one tool arranged to be inserted through at least one said main orifice and one said secondary orifice aligned with said main orifice in said at least one compartment, and arranged to make a measurement and/or adjustment to the timepiece housed inside said at least one compartment.

20. The device according to claim 19, wherein said manipulator includes as many sensors and/or tools as said at least one packaging box has of said at least one compartment.

21. The device according to claim 19, wherein said manipulator is arranged to manipulate each said packaging box in different positions, under different physical conditions, and includes control means arranged to control movements of each said packaging box in space and the duration of the testing in the different positions occupied by said packaging box, or when different movements are imparted to said packaging box.

22. The device according to claim 19, wherein said device is arranged to open and close the lid with respect to said base of said at least one packaging box, to perform at least one of a magnetic field test, pressure/depression test operation, a water resistance test operation, an etching operation, and a washing operation.

23. A method for testing a timepiece, comprising:

taking the packaging box according to claim 1 is taken in an open position;

said timepiece is placed inside a compartment of said at least one compartment of said at least one removable tray of said packaging box, at least underneath one said resilient pad centred inside said compartment with said secondary orifice of said resilient pad in alignment with said main orifice; wherein pressing said timepiece directly or indirectly onto said bottom by closing said lid of said packaging box compressing each said resilient pad; wherein manipulating said packaging box in different positions in space; and performing at least one testing operation of said timepiece of via a sensor and/or a tool inserted through said main orifice.

24. The testing method according to claim 23, wherein a device is implemented for manipulation of said packaging box.

25. The testing method according to claim 23, wherein a device is implemented for manipulating said packaging box in different positions, and wherein, in each said position, said timepiece is tested.

26. The testing method according to claim 23, wherein the testing of a plurality of timepieces is performed simultaneously, with each said timepiece enclosed in one said at least one compartment of said packaging box.

* * * * *